US011271342B2

(12) United States Patent
Bobelis et al.

(10) Patent No.: US 11,271,342 B2
(45) Date of Patent: Mar. 8, 2022

(54) PIN AND SLEEVE DEVICES

(71) Applicant: LEVITON MANUFACTURING CO., INC., Melville, NY (US)

(72) Inventors: Darius Bobelis, Hauppauge, NY (US); Amit Pai, Farmingville, NY (US); Maria Acosta, Bayside, NY (US); Robert Cannetti, Lindenhurst, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 16/481,944

(22) PCT Filed: Jul. 22, 2019

(86) PCT No.: PCT/US2019/042742

§ 371 (c)(1),
(2) Date: Jul. 30, 2019

(87) PCT Pub. No.: WO2020/046492

PCT Pub. Date: Mar. 5, 2020

(65) Prior Publication Data

US 2021/0167545 A1 Jun. 3, 2021

Related U.S. Application Data

(60) Provisional application No. 62/724,269, filed on Aug. 29, 2018.

(51) Int. Cl.
*H01R 13/52* (2006.01)
*H01R 13/18* (2006.01)
*H01R 13/59* (2006.01)

(52) U.S. Cl.
CPC ..... *H01R 13/5205* (2013.01); *H01R 13/18* (2013.01); *H01R 13/59* (2013.01)

(58) Field of Classification Search
None
See application file for complete search history.

(56) References Cited

U.S. PATENT DOCUMENTS 2,963,536 A 12/1960 Kokalas
3,020,516 A 2/1962 Despard
(Continued)

FOREIGN PATENT DOCUMENTS

DE 4437338 A1 1/1996
EP 0683545 A1 11/1995
(Continued)

OTHER PUBLICATIONS

Author unknown, "Pin & Sleeve" 2016 Leviton Manufacturing Co., Inc.

(Continued)

*Primary Examiner* — Ross N Gushi
(74) *Attorney, Agent, or Firm* — Kacvinsky Daisak Bluni PLLC

(57) ABSTRACT

An electrical pin and sleeve device is disclosed. The pin and sleeve device incorporating one or more features to provide improved protection (e.g., sealing) from the environment (e.g., rain, water, dust, etc.). Additionally, and/or alternatively, the pin and sleeve device may include one or more features to facilitate easier assembly and use. For example, the outer housing of the pin and sleeve device may include an inwardly extending projection defining a shelf for contacting a grommet positioned within the outer housing of the pin and sleeve device. Additionally, and/or alternatively, the pin and sleeve devices may incorporate a cable boot to provide an improved seal between the electrical cable and the clamp nut to prevent the ingress of water, dust, or the like.

19 Claims, 7 Drawing Sheets

(56) References Cited

U.S. PATENT DOCUMENTS

| | | | | |
|---|---|---|---|---|
| 3,120,987 | A | 2/1964 | Degnan | |
| 3,167,374 | A | 1/1965 | Healy | |
| 3,445,805 | A * | 5/1969 | McLoad | H01R 13/5221 439/277 |
| 3,581,269 | A | 5/1971 | Frey et al. | |
| 3,588,783 | A | 6/1971 | Newman | |
| 3,603,912 | A | 9/1971 | Kelly | |
| 3,611,255 | A | 10/1971 | Shroyer | |
| 3,792,415 | A | 2/1974 | Fuller | |
| 3,796,504 | A | 3/1974 | Marechal | |
| 4,030,741 | A | 6/1977 | Fidrych | |
| 4,063,793 | A | 12/1977 | Judd | |
| 4,114,974 | A | 9/1978 | Lawrence | |
| 4,145,075 | A | 3/1979 | Holzmann | |
| 4,218,110 | A | 8/1980 | Giannaula et al. | |
| 4,250,348 | A | 2/1981 | Kitagawa | |
| 4,421,369 | A | 12/1983 | Myking | |
| 4,580,865 | A * | 4/1986 | Fryberger | H01R 13/5205 439/277 |
| 5,259,782 | A | 11/1993 | Giffin | |
| 5,410,104 | A | 4/1995 | Gretz et al. | |
| 5,470,248 | A | 11/1995 | Wood | |
| 5,711,066 | A | 1/1998 | Castaldo | |
| 5,743,759 | A | 4/1998 | Pudims et al. | |
| 5,857,873 | A | 1/1999 | Castaldo | |
| 5,863,221 | A | 1/1999 | Castaldo | |
| 5,866,853 | A | 2/1999 | Sheehan | |
| 5,920,035 | A * | 7/1999 | Haney | B01D 61/02 174/652 |
| 6,017,243 | A | 1/2000 | Castaldo | |
| 6,331,123 | B1 | 12/2001 | Rodrigues | |
| 6,371,807 | B1 | 4/2002 | Takagishi et al. | |
| 6,605,781 | B2 | 8/2003 | Milanowski et al. | |
| 7,029,328 | B1 | 4/2006 | Mckenzie et al. | |
| 7,285,014 | B2 | 10/2007 | Castaldo et al. | |
| 7,857,647 | B2 * | 12/2010 | Bracci | H01R 13/5205 439/282 |
| 8,288,667 | B2 * | 10/2012 | Chiou | H02G 3/0658 174/652 |
| 10,256,566 | B2 * | 4/2019 | Eun | H01R 13/5202 |
| 10,404,050 | B2 * | 9/2019 | Hutsler | H01R 13/5205 |
| 2006/0033218 | A1 | 2/2006 | Hafner et al. | |
| 2006/0141844 | A1 | 6/2006 | Tufano | |
| 2006/0154502 | A1 | 7/2006 | Castaldo | |
| 2007/0037429 | A1 | 2/2007 | Scholler et al. | |
| 2009/0060420 | A1 | 3/2009 | Cull et al. | |
| 2012/0034809 | A1 | 2/2012 | Reimchen | |
| 2012/0135629 | A1 | 5/2012 | Montena et al. | |
| 2012/0329311 | A1 | 12/2012 | Duval et al. | |

FOREIGN PATENT DOCUMENTS

| | | | |
|---|---|---|---|
| GB | 490013 | A | 8/1938 |
| GB | 2204750 | A | 11/1988 |

OTHER PUBLICATIONS

International Search Report and Written Opinion for the International Patent Application No. PCT/US2019/042742, dated Oct. 10, 2019, 14 pages.

International Preliminary Report on Patentability for the International Patent Application No. PCT/US2019/042742, dated Mar. 11, 2021, 9 pages.

International Search Report and Written Opinion for corresponding PCT Application PCT/US2018/054793, dated Dec. 7, 2018.

Author Unknown, "50 Amp Wiring Devices"— © Copyright 2008 Leviton Manufacturing Co., Inc.

Author Unknown, "Black White—50A Locking Plugs and Connectors-3 Wire and 4 Wire Installation Instructions" © 2019 Leviton Mtg. Co., Inc.

* cited by examiner

PIN AND SLEEVE DEVICES

CROSS-REFERENCE TO RELATED APPLICATIONS

This application is a United States National Phase filing of International Application No. PCT/US19/42742, filed Jul. 22, 2019, which claims priority to, and the benefit of the filing date of, U.S. Provisional Patent Application Ser. No. 62/724,269, filed Aug. 29, 2018, entitled "Pin and Sleeve Devices," the entire contents of each application is hereby incorporated in its entirety.

FIELD OF THE DISCLOSURE

The present disclosure relates generally to electrical devices such as pin devices and corresponding sleeve devices, and more particularly to pin devices and sleeve devices incorporating one or more features to provide improved protection (e.g., sealing) from the environment (e.g., rain, water, dust, etc.).

BACKGROUND OF THE DISCLOSURE

Pin and sleeve devices including plugs, connectors, receptacles, inlets, mechanical interlocks, etc. are well known in the art. As used herein, pin devices and sleeve devices will be collectively referred to as pin and sleeve devices. Herein, a single device having either pins (e.g. a plug), sleeves (e.g. a connector), or both pins and sleeves will be referred to as a pin and sleeve device. However, reference to a pin and sleeve device is not intended to mean that any such device has to include both pins and sleeves. Such a device can include one or more pins, one or more sleeves, or both pins and sleeves.

Generally speaking, pin and sleeve devices are often used to supply electrical power in harsh or high abuse environments such as, for example, wet or corrosive environments. Pin and sleeve devices are well-suited to supply electrical power to heavy equipment such as, for example, welders, motors, compressors, conveyors, portable tools, portable lighting, etc. In use, pin and sleeve devices may provide electrical connections safe from dust and water. As such, pin and sleeve devices are designed to provide power connections that are safe and secure from the environment (e.g., moisture, dirt, grime, chemicals, etc.), prevent accidental disconnect under load, and ensure high strength durability. Pin and sleeve devices provide standardized connectors and may be rated at any suitable current and voltage levels. For example, pin and sleeve devices may be rated at current levels of 16 A, 20 A, 30 A, 32 A, 60 A, 100 A, 150 A, 200 A, 400 A, or the like. In addition, pin and sleeve devices may be rated at voltage levels of 125V, 240V, 250V, 480V, 600V, 100/130V, 125/250V, 102/208V, 200/250V, 208/250V, 277/480V, 346-415V, 347/600V, 380/415V, 440-460V, or others. Moreover, pin and sleeve devices may be rated for any suitable electrical phase configuration such as single-phase, three-phase delta, and three-phase wye.

It would be desirable to provide pin and sleeve devices with one or more features to provide improved protection (e.g., sealing) from the environment (e.g., rain, water, dust, etc.).

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an electrical pin and sleeve device including an outer housing, a clamp nut for securing an electrical cable to the device, the clamp nut being threadably coupled to an end of the outer housing, and a grommet positioned within the outer housing, wherein the outer housing includes an inwardly extending projection defining a shelf for contacting the grommet so that the grommet is positioned within the outer housing between the shelf and the clamp nut.

In an alternate embodiment, an electrical pin and sleeve device may include an outer housing, a clamp nut for securing an electrical cable to the device, the clamp nut being threadably coupled to an end of the outer housing, the clamp nut including a projection, and a cable boot coupled to the clamp nut, the clamp nut having a bore for passage of the electrical cable therethrough, the cable boot providing a seal between an outer circumference of the electrical cable and an inner surface of the clamp nut, wherein the cable boot is manufactured from one of a pliable rubber or an elastomer, the cable boot including a groove formed in an outer circumference thereof, the groove being sized and configured to receive the projection formed on the clamp nut.

BRIEF DESCRIPTION OF THE DRAWINGS

By way of example, a specific embodiment of the disclosed device will now be described, with reference to the accompanying drawings, in which.

Figure 1:
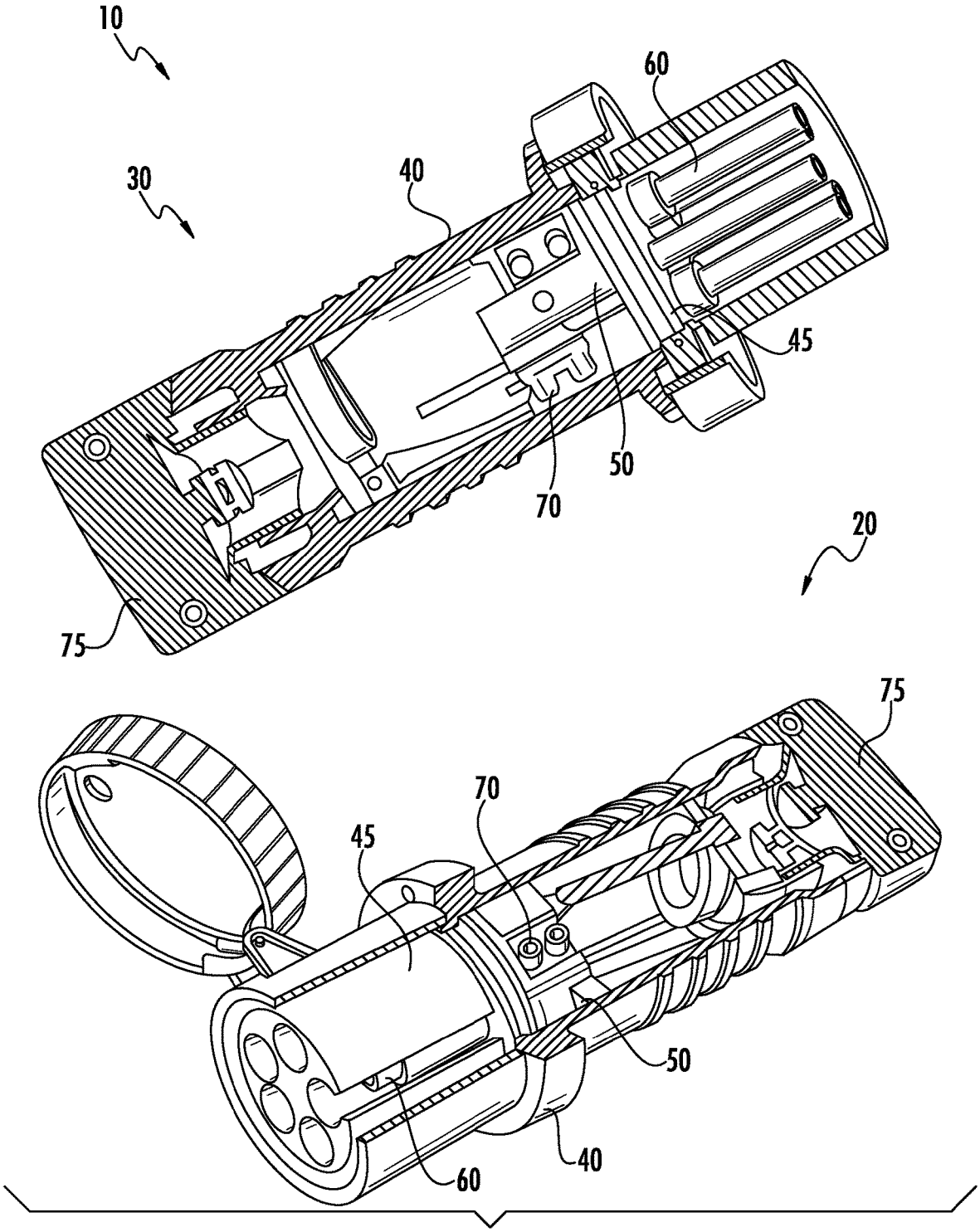
FIG. 1 (PRIOR ART)
FIG. 1 shows cut-away views of known pin and sleeve devices (e.g., a plug and a connector, respectively)

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of improved pin and sleeve devices in accordance with the present disclosure will now be described more fully hereinafter with reference to the accompanying drawings, in which preferred embodiments of the present disclosure are presented. As will be described and illustrated, in some embodiments, the electrical pin and sleeve device incorporates one or more features to provide improved protection (e.g., sealing) from the environment (e.g., rain, water, dust, etc.). The pin and sleeve device of the present disclosure may, however, be embodied in many different forms and should not be construed as being limited to the embodiments set forth herein. Rather, these embodiments are provided so that this disclosure will convey certain example aspects of the pin and sleeve device to those skilled in the art. In the drawings, like numbers refer to like elements throughout unless otherwise noted.

As will be described in greater detail below, in various embodiments, a pin and sleeve device according to the present disclosure may include one or more features to provide improved protection (e.g., sealing) from the environment (e.g., rain, water, dust, etc.). Additionally, and/or alternatively, the pin and sleeve device may include one or more features to facilitate easier assembly and use. That is, for example, according to the present disclosure, an electrical pin and sleeve device may include an inwardly extending projection extending from or molded into an outer housing of the pin and sleeve device, the projection defining a shelf for contacting a grommet positioned within the outer housing of the pin and sleeve device. In use, the shelf facilitates easier assembly and improved sealing to prevent the ingress of water, dust, or the like. Additionally, and/or alternatively, the pin and sleeve devices may incorporate a cable boot to provide an improved seal between the electrical cable and the clamp nut to prevent the ingress of water, dust, or the like.

As will be described herein, the features according to the present disclosure may be used with any suitable electrical pin and sleeve device now known or hereafter developed. As such, details regarding construction and operation of the electrical pin and sleeve devices are omitted for sake of brevity of the present disclosure. In this regard, the present disclosure should not be limited to the details of the electrical pin and sleeve device disclosed and illustrated herein unless specifically claimed and that any suitable electrical pin and sleeve device can be used in connection with the principles of the present disclosure.

Generally speaking, as will be appreciated by one of ordinary skill in the art, pin and sleeve devices are used to supply power to connected devices. As will be appreciated by one of ordinary skill in the art, pin and sleeve devices may encompass plugs, connectors, receptacles, inlets, mechanical interlocks, etc. These devices will be collectively referred to herein as a pin and sleeve device without the intent to limit.

Referring to FIG. 1, in one embodiment, a connector 20 may be connected to power and a plug 30 may be connected to a downstream electrical device, or vice-versa. In use, the plug 30 may be connected to the connector 20 to supply power to the downstream electrical device. As will be readily appreciated by one of ordinary skill in the art, each of the pin and sleeve devices 10 may include an outer housing 40, a contact carrier 45, and electrical contacts 60. The pin and sleeve devices 10 may also include a body member 50. The electrical contacts 60 in the connector 20 may generally be in the form of sleeves while the electrical contacts 60 in the plug 30 may generally be in the form of pins for contacting the sleeves in the connector 20. Sleeves and pins are arranged and configured to electrically contact and mechanically engage with each other. Optionally, each of the pin and sleeve devices 10 may also include one or more terminal screws 70 for securing electrical conductors of an electrical cable 15 (FIG. 2) to the contacts 60, a clamp nut, cord clamp, a collet nut, etc. (used interchangeable herein without the intent to limit) 75 for securing the electrical cable 15 (FIG. 2) to the pin and sleeve device 10, one or more grommets or seals, a cap, etc. Additionally, as will be appreciated by one of ordinary skill in the art, an inlet (not shown) may be used in place of a plug for coupling to a connector and/or a receptacle may be used in place of a connector for coupling to a plug in a panel or box mount.

Figure 2:
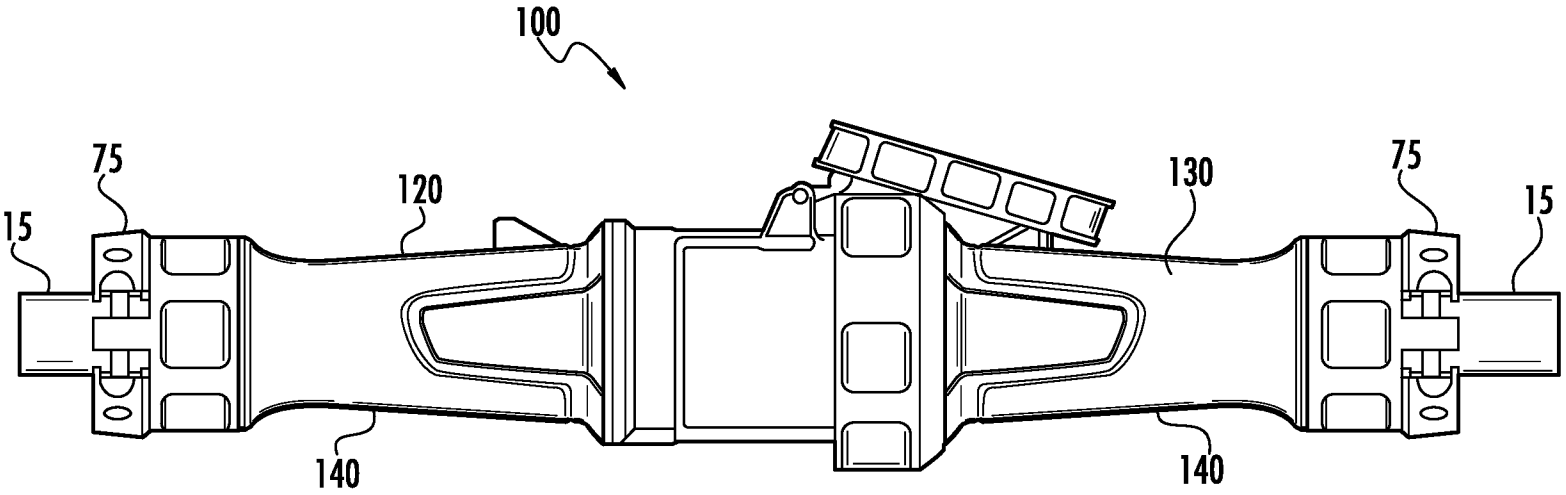
FIG. 2 is a side view of example embodiments of pin and sleeve devices in accordance with one aspect of the present disclosure, the pin device shown coupled to the sleeve device.

In accordance with one or more various aspects of the present disclosure, referring to FIG. 2, as will be appreciated by one of ordinary skill in the art, a plug 130 may be coupled to a connector 120. As previously mentioned, the connector 120 may be connected to power via electrical conductors of a first electrical cable 15 and the plug 130 may be connected to a downstream electrical device via electrical conductors of a second electrical cable 15. In this manner, power may be supplied to the downstream electrical device.

Figure 3:
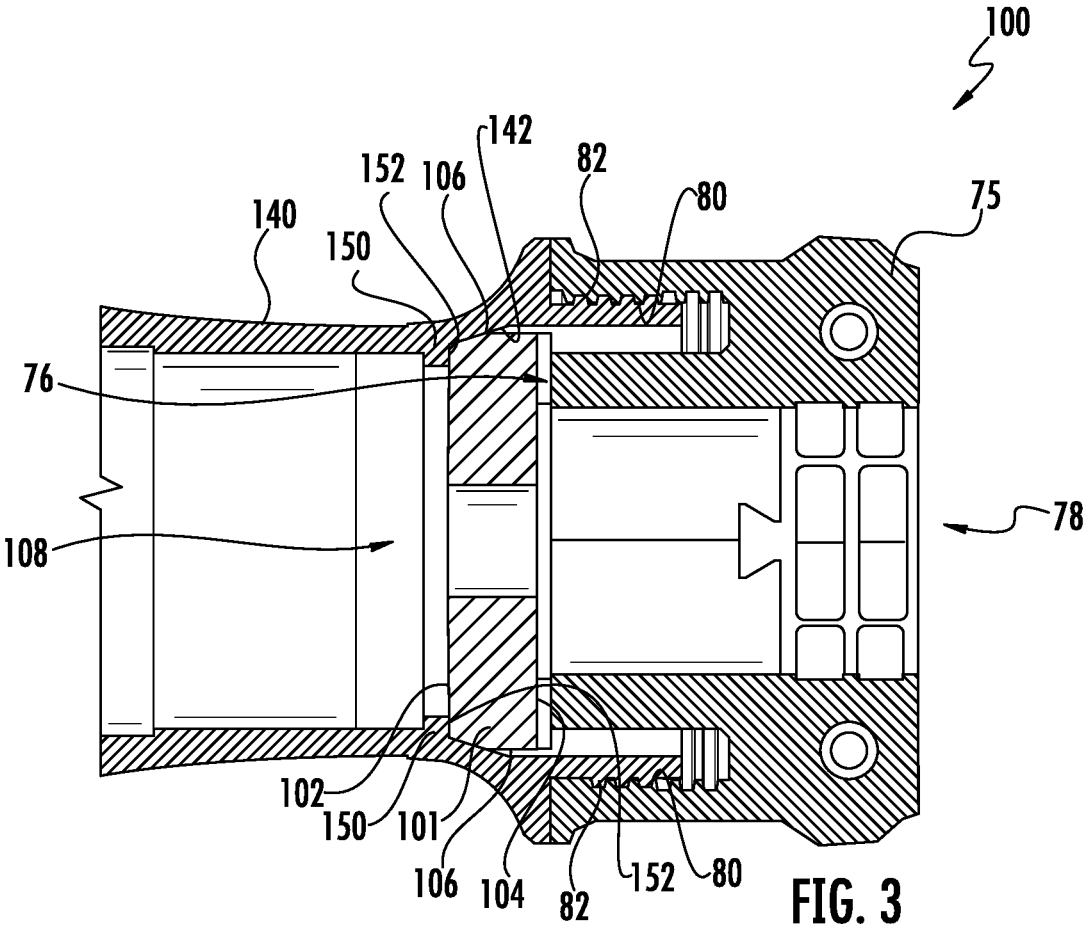
FIG. 3 is a partial cross-section view of an example embodiment of an outer housing of a pin and sleeve device, the outer housing including an example embodiment of a shelf for receiving a grommet in accordance with one aspect of the present disclosure.

As previously mentioned, the pin and sleeve device 100 may include a clamp nut 75 for securing an electrical cable 15 (FIG. 2) to the pin and sleeve device 100. Referring to FIG. 3, in accordance with one aspect of the present disclosure, the pin and sleeve device 100 may include a clamp nut 75 operatively coupled to an outer housing 140 of the pin and sleeve device 100. The clamp nut 75 may include a bore 78 for enabling the electrical cable 15 (FIG. 2) to pass therethrough so that it may be electrically connected to the contacts 60 via the terminal screws 70. The clamp nut 75 may be operatively coupled to the outer housing 140 of the pin and sleeve device 100 by any suitable mechanism now known or hereafter developed. Additionally, and/or alternatively, the clamp nut 75 can be provided in any suitable form now known or hereafter developed. For example, the clamp nut 75 may include threads 80 for threadably engaging the outer housing 140 of the pin and sleeve device 100. As illustrated, in one embodiment, the clamp nut 75 may include internal threads 80 for engaging external threads 82 formed on the outer housing 140 of the pin and sleeve device 100.

Referring to FIG. 3, as illustrated in one example embodiment, the pin and sleeve device 100 may include a grommet 101 positioned within the outer housing 140 of the pin and sleeve device 100, the grommet 101 may be positioned between the outer housing 140 and the clamp nut 75. In use, the grommet 101 may include a first side 102, a second side 104, an outer circumference 106, and a central opening 108 for enabling the electrical cable 15 to pass therethrough. In use, the grommet 101 protects the electrical cable 15 from abrasion and/or protects the pin and sleeve device 100 from the outside environment (e.g., grommet 101 seals space between the electrical cable 15 and the outer housing 140 from ingress of dust, water and the like).

The grommet 101 may be manufactured from any suitable material now known or hereafter developed including, for example, metal, plastic, etc. In the illustrated example embodiment, the grommet 101 is preferably manufactured from a pliable rubber such as, for example, an elastomer.

In accordance with one aspect of the present disclosure, in the illustrated example embodiment of FIG. 3, the outer housing 140 includes an inwardly protruding projection defining a shelf 150 for receiving and contacting the grommet 101. The shelf 150 may be molded into the outer housing 140. Alternatively, the shelf 150 may be separately formed and connected to the outer housing 140.

As illustrated, in one embodiment, the shelf 150 includes a grommet facing side 152. Additionally, the clamp nut 75 includes a grommet facing side 76. In use, the grommet facing side 152 of the shelf 150 and the grommet facing side 76 of the clamp nut 75 have parallel faces for contacting the grommet 101 therebetween.

In use, by contacting or sandwiching the grommet 101 between the parallel faces 76, 152 on the clamp nut 75 and the shelf 150 formed on the outer housing 140 of the pin and sleeve device 100, the shelf 150 acts to support the grommet 101 as the grommet 101 is being compressed into the outer housing 140 via, for example, rotation of the clamp nut 75. Additionally, the shelf 150 prevents unwanted movement or twisting of the grommet 101 that can create sealing voids. Moreover, the shelf 150 better assures adequate radial and axial compression to affect an improved seal by retaining the installed position of the grommet 101 during use.

That is, utilization of the shelf 150 facilitates an improved axial compression between the shelf 150 and the grommet 101, which compresses the grommet 101 during rotation of the clamp nut 75, which in turn causes the grommet 101 to radially expand creating radial compression (e.g., squeezing) between an outer circumference 106 of the grommet 101 and an inner surface 142 of the housing 140 during insertion of the grommet 101 to its seated position. This helps to ensure a tight fit to prevent ingress of dust, water, or the like. In addition, the shelf 150 supports the grommet 101 and locks it into place. For example, the shelf 150 helps ensures that the position of the grommet 101 does not move, for example, during movement of the electrical cable 15 during assembly (e.g., the shelf 150 prevents the grommet 101 from being pulled too far into the outer housing 140 during assembly when the electrical cable 15 is being pulled through for securing to the contacts 60). As a result, the shelf 150 helps prevents the grommet 101 from moving, twisting, or the like, which can result in unwanted gaps or openings, and thus improper sealing.

Figure 4:
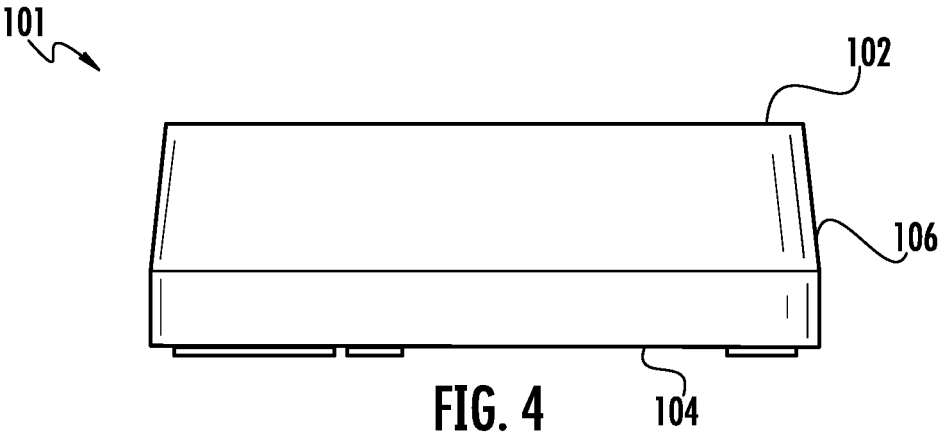
FIG. 4 is a side view of an example embodiment of a grommet used in connection with the outer housing shown in FIG. 3.

Referring to FIG. 4, in one example embodiment, the grommet 101 may include a first side 102 for contacting with, for example, the grommet facing side 152 of the shelf 150, a second side 104 for contacting with, for example, the grommet facing side 76 of the clamp nut 75, and a tapered outer circumference or diameter 106. As illustrated, the tapered outer circumference 106 may extend the entire width of the grommet 101 from the second side 104 to the first side 102. Alternatively, the tapered outer circumference 106 may only extend a partial length thereof, preferably from the first side 102. Incorporating a tapered outer circumference 106 facilitates easier assembly and provides an improved seal.

That is, by providing a tapered outer circumference 106, the grommet 101 is more easily positioned or inserted into proper location prior to applying compression (e.g., the tapered outer circumference 106 facilitates proper positioning of the grommet 101 within the outer housing 140 prior to rotation of the clamp nut 75). For example, in one example embodiment, the clamp nut 75 and the outer housing 140 may be adapted and configured so that, during assembly, the threads 80 formed on the clamp nut 75 threadably engage the corresponding threads 82 formed on the outer housing 140 prior to the grommet facing side 76 of the clamp nut 75 contacting the grommet 101.

In use, the tapered outer circumference 106 allows the grommet 101 to ease into its fully seated position and/or limits the amount of compression required for sealing (e.g., limits the amount of required compression needed to move the grommet 101 into proper position). Thus, providing a grommet 101 with a tapered outer circumference 106 facilitates easier assembly by promoting early engagement with the outer housing 140.

In one example embodiment, the taper formed on the outer circumference 106 of the grommet 101 may substantially match a corresponding tapered surface 142 formed on the mating part such as, for example, the outer housing 140. Providing corresponding tapered surfaces 142, 106 facilitates early engagement and limits the amount of force or motion necessary to insert the grommet 101. Corresponding tapered surfaces 142, 106 also allows for easier assembly when the grommet 101 is cold and/or stiff. Additionally, corresponding tapers 142, 106 facilitate an improved fit between the outer circumference 106 of the grommet 101 and the corresponding inner surface 142 of the mating part (e.g., outer housing 140) thus ensuring a tight fit to prevent ingress of dust, water, or the like.

Figure 5:
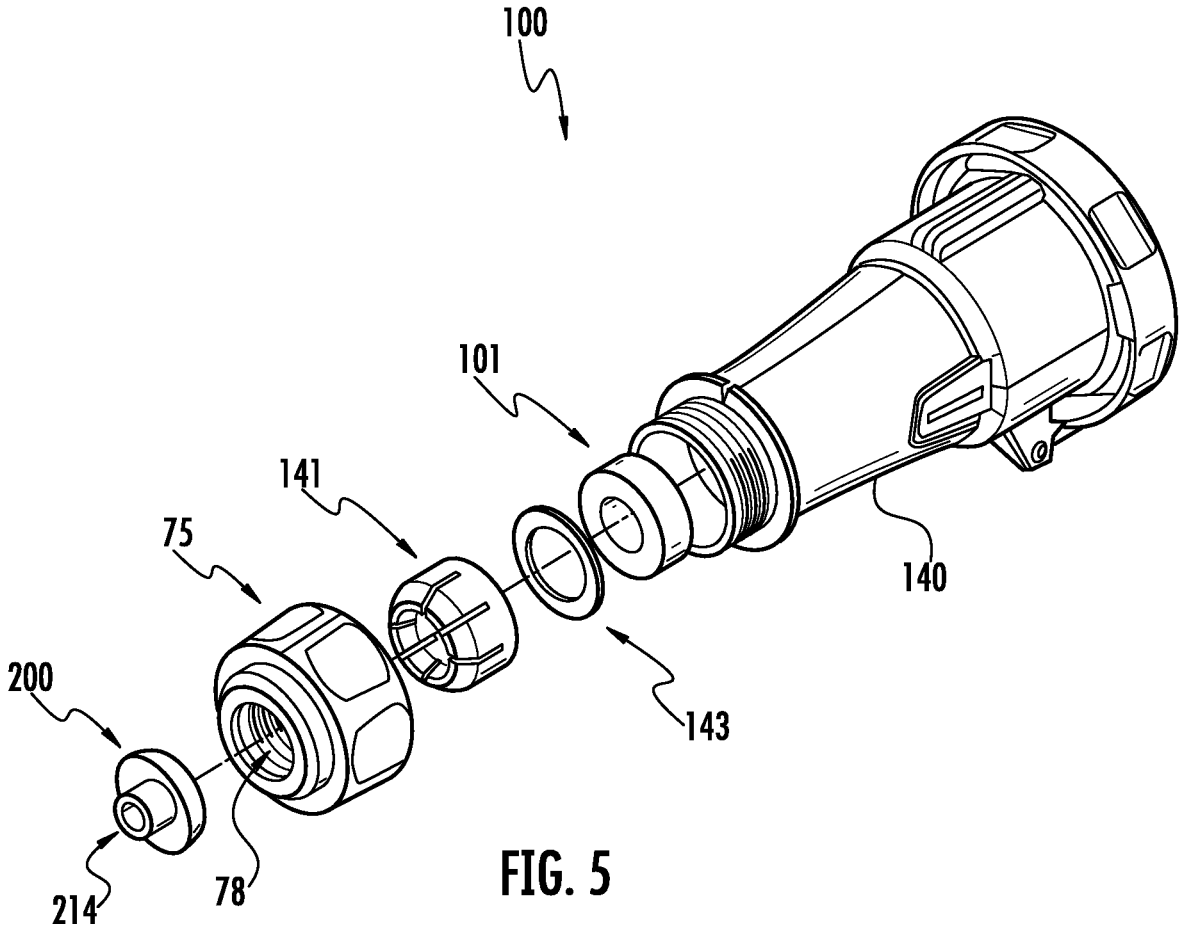
FIG. 5 is an exploded, perspective view of an example embodiment of a pin and sleeve device, the pin and sleeve device incorporating an example embodiment of a cable boot in accordance with one aspect of the present disclosure.

Referring to FIG. 5, in one embodiment, the pin and sleeve device 100 may include an outer housing 140, a grommet 101, an insert 141, a washer 143, and a clamp nut 75, which in this embodiment may be in the form of, for example, a collet nut. As will be appreciated by one of ordinary skill in the art, in one non-limiting embodiment, after the electrical cable 15 has been inserted into the pin and sleeve device 100, rotation of the clamp nut 75 (e.g., collet nut) compresses the insert 141 against the electrical cable 15 such as, for example, via corresponding tapered surfaces, to secure the position of the electrical cable 15 relative to the pin and sleeve device 100. In addition, rotation of the clamp nut 75 (e.g., collet nut) may cause the insert 141 to press against the washer 143, which contacts and compresses the grommet 101. As will be appreciated by one of ordinary skill in the art, this arrangement and specifically the utilization of the collet nut 75 is particularly beneficial for waterproof applications.

As illustrated, in accordance with one aspect of the present disclosure, the pin and sleeve device 100 may also incorporate a cable boot 200. In use, the cable boot 200 may be coupled to the clamp nut (e.g., collet nut) 75 for preventing ingress of water, dust, or the like through the borehole 78 formed in the clamp nut (e.g., collet nut) 75 for receiving the electrical cable 15 and into the terminal area.

The cable boot 200 may be manufactured from any suitable material now known or hereafter developed including, for example, a pliable rubber such as, for example, an elastomer.

Figure 6:
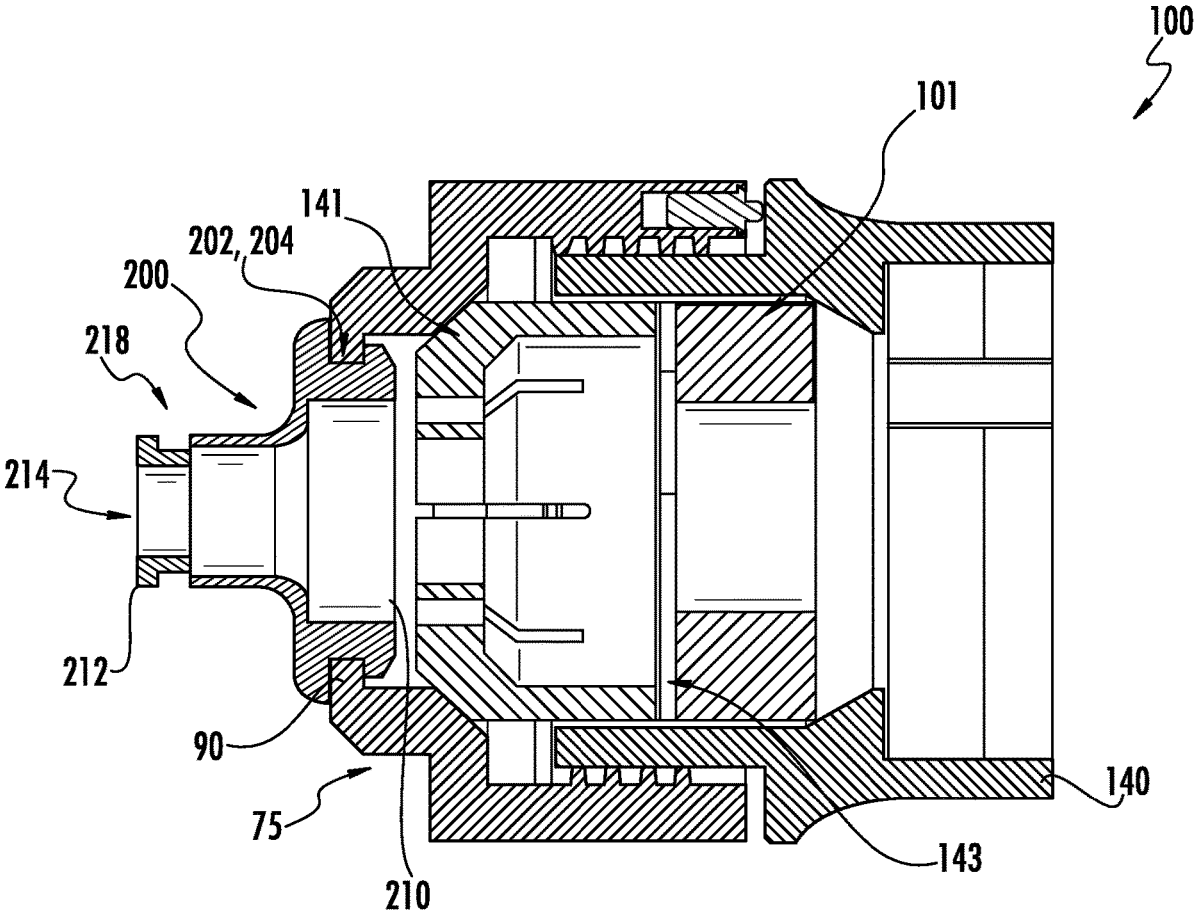
FIG. 6 is a partial cross-sectional view of the pin and sleeve device shown in FIG. 5.

In use, the cable boot 200 may be coupled to the clamp nut (e.g., collet nut) 75 by any suitable mechanism now known or hereafter developed. As illustrated in FIG. 6, the cable boot 200 may include a groove 204 formed in an outer circumference 202 thereof for receiving a projection 90 formed on the clamp nut (e.g., collet nut) 75 to couple the cable boot 200 to the clamp nut 75. As illustrated, the cable boot 200 includes a first end 210, a second end 212, and a bore 214 extending from the first end 210 to the second end 212 for enabling the electrical cable 15 to pass therethrough. In use, the bore 214 formed in the cable boot 200 may be aligned with the bore 78 formed in the clamp nut (e.g., collet nut) 75, insert 141, grommet 101, etc. so that the electrical cable 15 may pass through and into contact with the terminal contacts 60 of the pin and sleeve device 100.

As illustrated in the example embodiment of FIG. 6, the cable boot 200 may include a groove or recess 218 for receiving, for example, a cable tie, wrap spring, clamp, or the like (not shown). As illustrated, the groove or recess 218 may be circumferential formed in the outer surface of the cable boot 200 adjacent to the first end 212 thereof. In use, the groove or recess 218 is adapted and configured to receive, for example, the cable tie, wrap spring, clamp, or the like to prevent or minimize the existence of gaps between the outer surface of the electrical cable 15 and the inner surface of the cable boot 200 during, for example, bending or flexion of the cable 15 and/or boot 200, or if the outer diameter of the cable 15 is smaller than the inner surface of the cable boot 200. In use, the groove or recess 218 prevents the cable tie, wrap spring, clamp, or the like from slipping off during use.

Utilization of the cable boot 200 provides an improved seal between the space or gap between the outer diameter of the electrical cable 15 and the inner diameter of the borehole formed in the clamp nut (e.g., collet nut) 75 to prevent the ingress, accumulation, and/or entrapment of water, debris, or the like. In use, the cable boot 200 is adapted and configured to provide a snug fit within the inner diameter of the borehole formed in the clamp nut (e.g., collet nut) 75 and against the outer diameter of the of the electrical cable 15 ensuring that the cable boot 200 provides an improved seal around multiple different sizes of electrical cable 15 while preventing ingress of water, debris, or the like from entering the outer housing 140 of the pin and sleeve device 100.

Additionally, in one embodiment, the cable boot 200 includes a smooth outer surface that does not trap water, debris, or the like.

Figure 7:
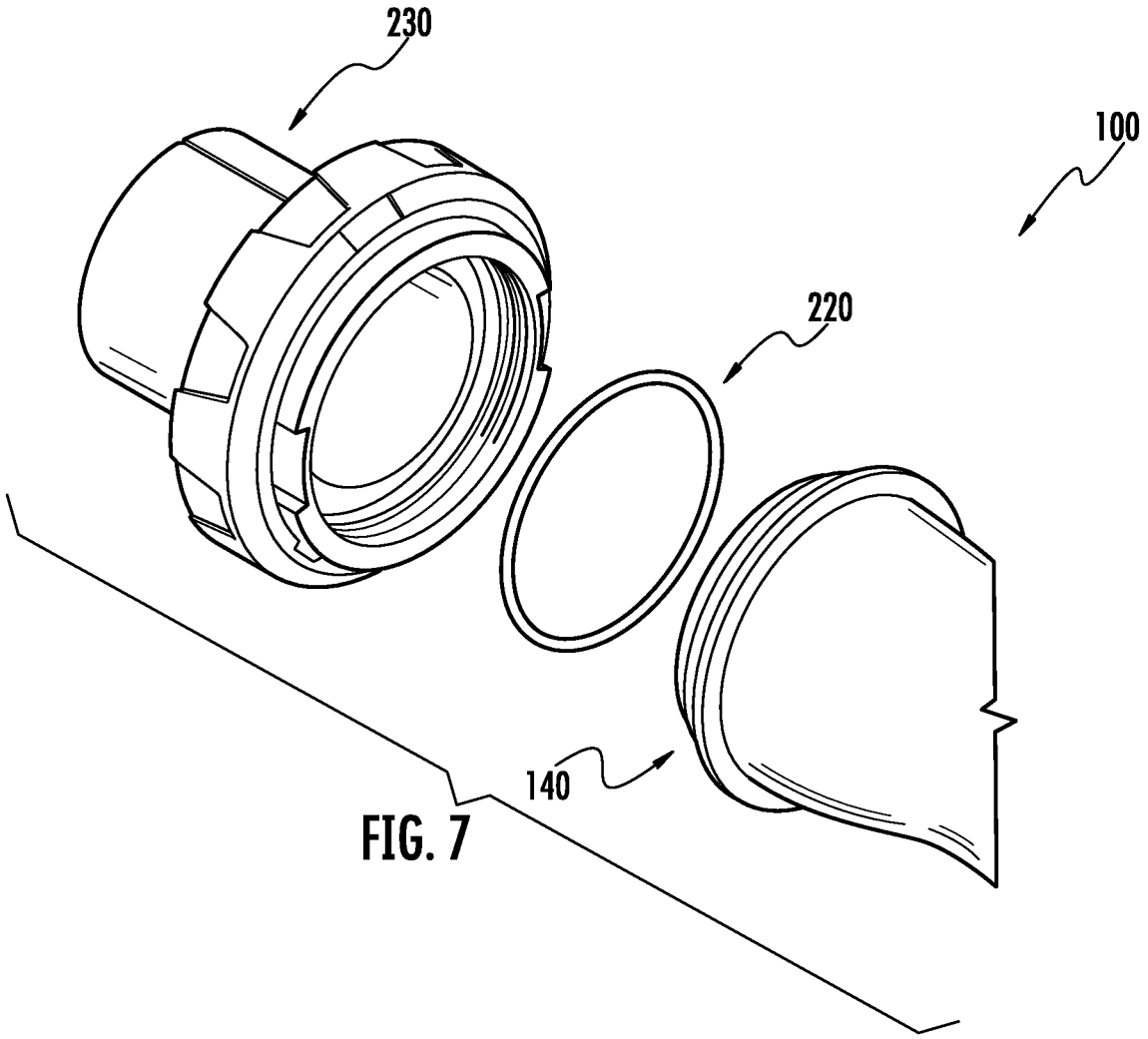
FIG. 7 is an exploded, partial perspective view of a pin and sleeve device incorporating a hollow O-ring in accordance with one aspect of the present disclosure.
Figure 8:
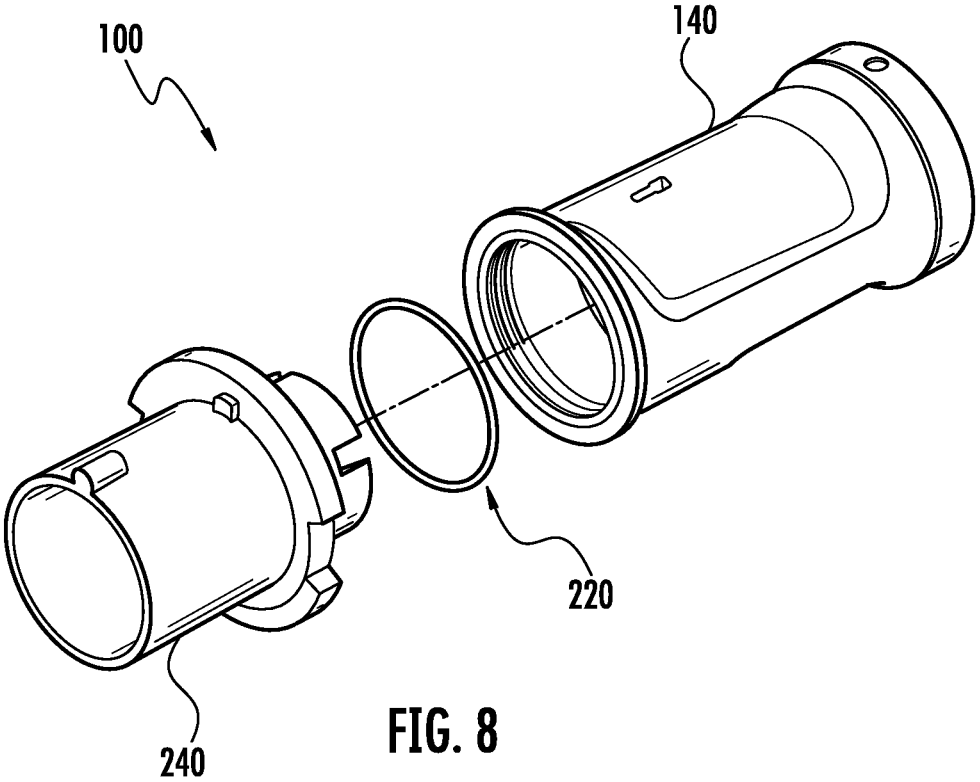
FIG. 8 is an exploded, partial perspective view of a pin and sleeve device incorporating a hollow O-ring in accordance with one aspect of the present disclosure.

Referring to FIGS. 7 and 8, and as will be appreciated by one of ordinary skill in the art, incorporation of seals such as, for example, O-rings between interconnected parts in devices is well known. For example, it is known to use O-rings to seal imperfect mating surfaces in cylindrical parts or between imperfect surfaces (e.g., molded plastic parts). As illustrated in FIG. 7, in one example embodiment, an O-ring 220 may be positioned between the outer housing 140 and a front housing 230 of the pin and sleeve device 100. Alternatively, as illustrated in FIG. 8, in one example embodiment, an O-ring 220 may be positioned between the outer housing 140 and a main body portion 240 of the pin and sleeve device 100. In use, as will be appreciated by one of ordinary skill in the art, an O-ring 220 may be used between any two parts.

In accordance with one non-limiting aspect of the present disclosure, the O-ring 220 is a hollow O-ring. Providing a hollow O-ring allows for improved sealing between imperfect surfaces without requiring heavy preloads or interference. In addition, utilization of hollow O-rings allows mating parts to maintain seal when surfaces are deflected or distorted due to heavy applied loads.

In contrast to standard O-rings that rely on heavy compression to affect a seal, hollow O-rings require much less force to compress and effect a seal. In addition, utilization of hollow O-rings also reduces stress and distortion on the mating components when assembled, ensuring proper and effective sealing with low torque applications in extreme environmental (wet, cold, icy) conditions.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. An electrical pin and sleeve device comprising:

an outer housing;

a clamp nut for securing an electrical cable to the device, the clamp nut being threadably coupled to an end of the outer housing, the clamp nut having a bore for passage of the electrical cable therethrough, the clamp nut including a circumferential projection extending into at least a portion of the bore; and a cable boot coupled to the clamp nut, the cable boot providing a seal between an outer circumference of the electrical cable and an inner surface of the clamp nut;

wherein the cable boot is manufactured from one of a pliable rubber or an elastomer, the cable boot including a first circumferential groove formed in an outer surface of a first end of the cable boot, the first circumferential groove being sized and configured to receive the circumferential projection of the clamp nut; and wherein the cable boot includes a second circumferential groove formed in the outer surface of a second end of the cable boot, the groove configured to receive a clamping member.

2. The pin and sleeve device of claim 1, further comprising a hollow O-ring, positioned between the outer housing and a front housing portion of the device.

3. The pin and sleeve device of claim 1, further comprising a grommet positioned within the outer housing, the outer housing including an inwardly extending projection defining a shelf for contacting the grommet so that the grommet is positioned within the outer housing between the shelf and the clamp nut.

4. The pin and sleeve device of claim 3, wherein the shelf includes a grommet facing side for contacting a first side of the grommet and the clamp nut includes a grommet facing side for contacting a second side of the grommet, the grommet facing side of the shelf and the grommet facing side of the clamp nut having parallel faces for contacting the grommet therebetween.

5. The pin and sleeve device of claim 4, wherein the grommet includes a tapered outer circumference.

6. The pin and sleeve device of claim 5, wherein the outer housing includes a tapered inner surface substantially similar to the tapered outer circumference of the grommet.

7. The pin and sleeve device of claim 3, wherein the grommet includes a first side for contacting with the grommet facing side of the shelf, a second side for contacting with the grommet facing side of the clamp nut, and a tapered outer circumference.

8. The pin and sleeve device of claim 7, wherein the clamp nut includes a plurality of threads and the outer housing includes a plurality of threads, the plurality of threads formed on the clamp nut threadably engaging the threads formed on the outer housing prior to the grommet facing side of the clamp nut contacting the grommet.

9. The pin and sleeve device of claim 8, wherein the outer housing includes a tapered inner surface substantially similar to the tapered outer circumference of the grommet.

10. The electrical pin and sleeve device of claim 1, further comprising:

a grommet positioned within the outer housing; and an O-Ring positioned within the device;

wherein the outer housing includes an inwardly extending projection defining a shelf for contacting the grommet so that the grommet is positioned within the outer housing between the shelf and the clamp nut; the outer housing including an inner tapered surface positioned adjacent to the shelf for contacting the grommet.

11. The electrical pin and sleeve device of claim 1, wherein the outer housing includes a borehole and a tapered inner surface, the tapered inner surface extending inwardly from the borehole; and a grommet positioned within the borehole of the outer housing;

wherein the outer housing includes an inwardly extending projection defining a shelf for contacting the grommet so that the grommet is positioned within the outer housing between the shelf and the clamp nut, the shelf being positioned adjacent to the tapered inner surface of the outer housing; and wherein the grommet includes a partly tapered outer circumference including a first segment having a cylindrical non-tapered outer circumference and a second segment having a tapered outer circumference configured to contact the tapered inner surface of the outer housing, the second segment being non-discontinuous with the first segment so that the taper outer circumference of the grommet extends directly from an end of the non-tapered outer circumference of the grommet.

12. The electrical pin and sleeve device of claim 1, further comprising:

a grommet including: an outer diameter and an inner diameter defined by a borehole; wherein the inner diameter of the grommet is selected to sealingly receive the electric cable;

wherein the outer housing has a borehole sized and configured to axially receive the grommet between the clamp nut and the outer housing, the outer housing borehole further includes a circumferential projection extending inwardly into the outer housing borehole such that a shelf is formed, wherein the shelf has an inner diameter that is less than the outer diameter of the grommet but greater than the inner diameter of the grommet, the outer housing including an inner tapered surface positioned adjacent to the shelf.

13. The pin and sleeve device of claim 12, wherein the shelf includes a grommet facing side for contacting a first side of the grommet and the clamp nut includes a grommet facing side for contacting a second side of the grommet, the grommet facing side of the shelf and the grommet facing side of the clamp nut having parallel faces for contacting the grommet therebetween.

14. The pin and sleeve device of claim 13, wherein the grommet includes a tapered outer circumference substantially similar to the tapered inner surface of the outer housing.

15. The pin and sleeve device of claim 12, wherein the grommet includes a first side for contacting the grommet facing side of the shelf, a second side for contacting the grommet facing side of the clamp nut, and a tapered outer circumference.

16. The pin and sleeve device of claim 15, wherein the clamp nut and the outer housing are adapted and configured so that, during assembly, threads formed on the clamp nut threadably engage corresponding threads formed on the outer housing prior to the grommet facing side of the clamp nut contacting the grommet.

17. The pin and sleeve device of claim 12, wherein the grommet is manufactured from a pliable rubber or elastomer.

18. The pin and sleeve device of claim 12, wherein the grommet is sized and configured so that when the clamp nut is threadably coupled to the end of the outer housing the grommet is axially compressed and radially expanded such that an outer circumference of the grommet radially presses against an inner surface of the outer housing.

19. An electrical pin and sleeve comprising:

a front housing portion;

an outer housing coupled to the front housing portion;

a hollow O-ring positioned between the outer housing and the front housing portion;

a clamp nut for securing an electrical cable to the device, the clamp nut being threadably coupled to an end of the outer housing; and a grommet positioned within the outer housing;

wherein the outer housing includes an inwardly extending projection defining a shelf for contacting the grommet so that the grommet is positioned within the outer housing between the shelf and the clamp nut.

* * * * *